US005415055A

United States Patent [19]

Henfrey

[11] Patent Number: 5,415,055

[45] Date of Patent: May 16, 1995

[54] DRIVE MECHANISM FOR A VERTICALLY ROTATING MEMBER

[75] Inventor: Kenneth M. Henfrey, Ascot, United Kingdom

[73] Assignee: Sine Engineering Ltd., Bookham, United Kingdom

[21] Appl. No.: 50,006

[22] PCT Filed: Sep. 25, 1991

[86] PCT No.: PCT/GB91/01653

§ 371 Date: Apr. 22, 1993

§ 102(e) Date: Apr. 22, 1993

[87] PCT Pub. No.: WO92/05314

PCT Pub. Date: Apr. 2, 1992

[51] Int. Cl.[6] ..... F16H 21/44

[52] U.S. Cl. ..... 74/96; 49/49; 49/200

[58] Field of Search ..... 74/96 R; 49/49, 199, 49/200

[56] References Cited

U.S. PATENT DOCUMENTS

| | | | |
|---|---|---|---|
| 3,153,802 | 10/1964 | Howard | 74/96 |
| 3,196,238 | 7/1965 | Freund et al. | 74/96 |
| 3,307,583 | 3/1967 | Harter | 74/96 |
| 4,848,175 | 7/1989 | Weiss | 74/96 |
| 4,897,960 | 2/1990 | Barvinek et al. | 49/49 |
| 4,926,707 | 5/1990 | Yamada | 74/96 |

FOREIGN PATENT DOCUMENTS

| | | |
|---|---|---|
| 0290957 | 11/1988 | European Pat. Off. . |
| 2199793 | 4/1974 | France . |
| 2330837 | 6/1977 | France . |
| 189526 | 11/1922 | United Kingdom . |
| 898945 | 6/1962 | United Kingdom . |
| 973166 | 10/1964 | United Kingdom . |
| 2214566 | 9/1989 | United Kingdom . |

*Primary Examiner*—John T. Kwon

*Attorney, Agent, or Firm*—Jacobson, Price, Holman & Stern

[57] ABSTRACT

A drive mechanism for a pivoted member (1), such as a beam of a traffic barrier, comprises a rotary element (6) coupled to the pivoted member (1). A friction roller (7) for driving the rotary element (6) is supported on a mounting (8) that is pivoted on an axis (9) and biased about the axis (9) to hold the friction roller (7) in pressure contact with the rotary element (6). When the friction roller (7) is driven to rotate the element (6) to raise the pivoted member (1), the frictional force between the roller (7) and the driven element (6) is increased, whereas the frictional driving force is reduced when the roller (7) is rotated in the reverse direction.

13 Claims, 4 Drawing Sheets

Figure 1:
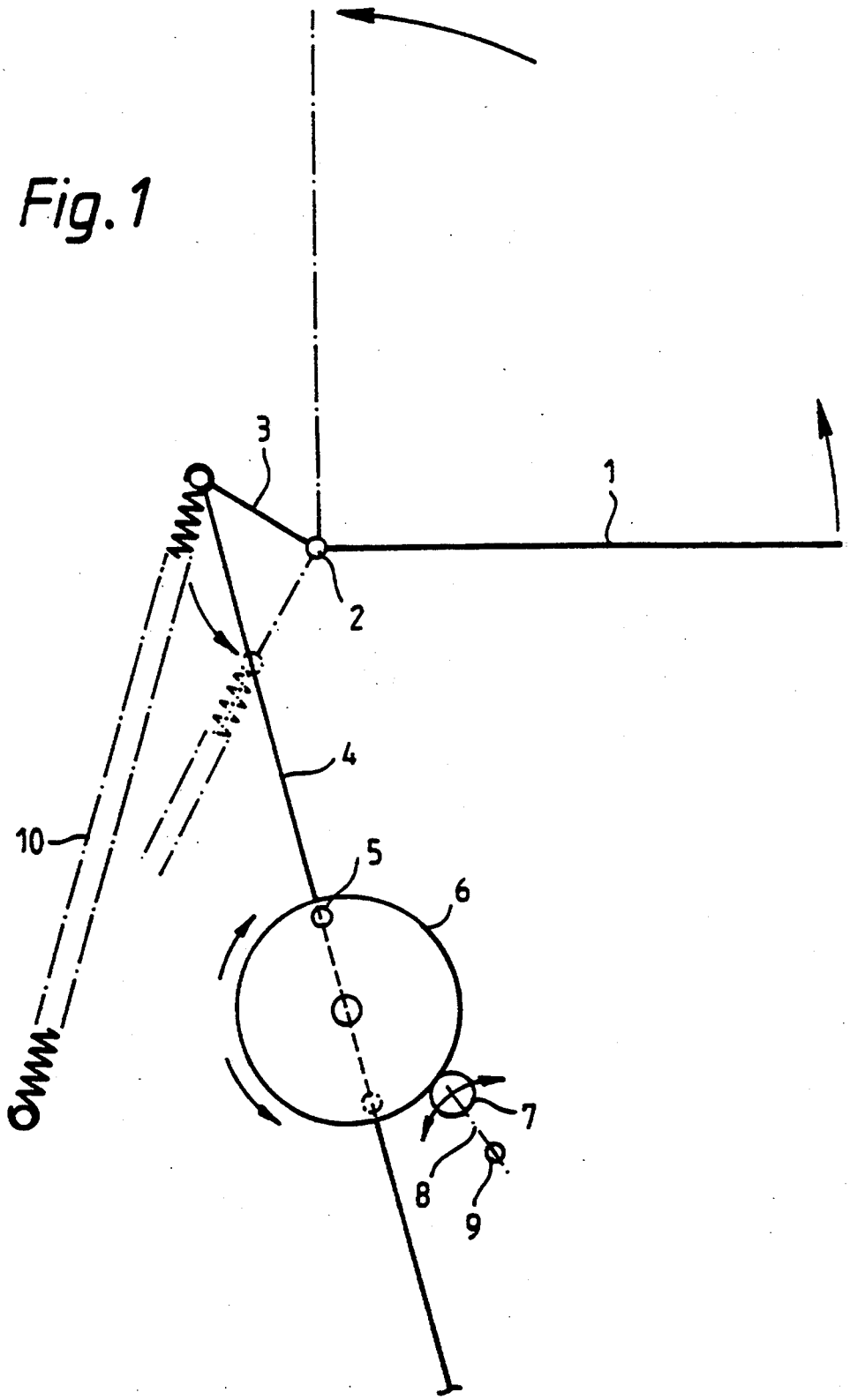

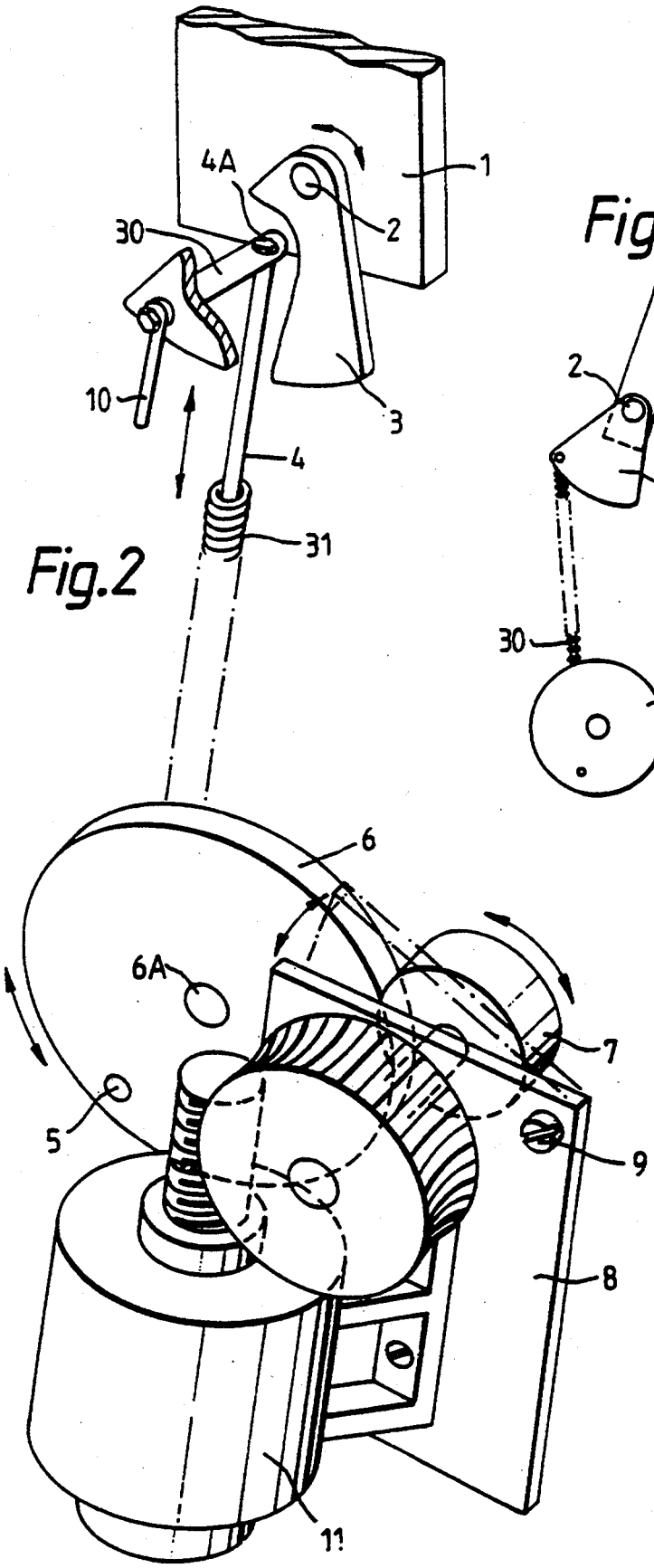
Fig.2
Fig.2A
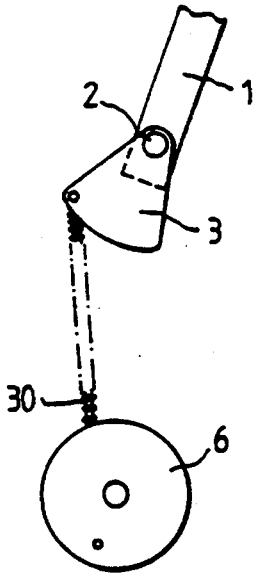
Fig.2B
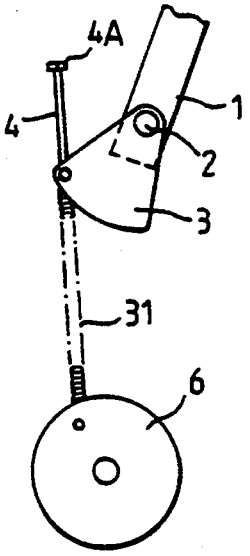

DRIVE MECHANISM FOR A VERTICALLY ROTATING MEMBER

This invention concerns a drive mechanism for a vertically rotating member, more especially for a vertically rotating beam or barrier of the kind intended for use in controlling the passage of vehicles or other traffic.

Barriers operating through vertical angles of about 90° are well-known devices for controlling the flow of traffic to and from restricted areas. Such a barrier generally includes a drive mechanism comprising a member pivoted about an axis intended, in use, to be generally horizontal, a rotary element coupled to said member in such a manner that, with said axis horizontal, rotation of said element in a first direction is effective to raise a radially extending portion of said member relatively to said axis and rotation of said element in a reverse direction is effective to lower said portion of said member relatively to said axis, and a reversible drive means for driving said element.

Although the motion of such a barrier is relatively simple, the drive mechanism required to transmit movement to the barrier is subject to conflicting requirements that have hitherto been met only partially, and/or with the use of relatively complicated and expensive mechanisms. Thus, for example, it is required that the driving force applied to such a barrier during movement in the downward direction should be limited to provide safety for pedestrians and vehicles that may inadvertently enter the path of the barrier during its downward movement. On the other hand, the barrier and its associated drive mechanism should be resistant to attempts to force the barrier upward from its horizontal position to permit unauthorised entry to or exit from premises controlled by the barrier. The drive mechanism should be capable of accommodating varying loads placed on the barrier during movement in the upward direction, for example due to accumulation of ice or snow thereon, and also the mechanism should be capable of being released rapidly by an authorised person to enable emergency movement of the barrier by manual means without requiring complicated adjustment of the mechanism to enable resetting of the barrier for powered operation.

It is accordingly an object of the present invention to provide a drive mechanism capable of meeting one or more of the above requirements in an improved manner.

According to one aspect of the invention, a drive mechanism of the kind referred to above is characterised in that the reversible drive means includes a friction roller for engagement with a surface of said element extending circumferentially about the rotary axis thereof, said friction roller being supported for rotation upon a mounting pivoted relatively to the rotary axis of said element and biased in a direction such as to bring the friction roller into pressure contact with said surface, the arrangement being such that when said friction roller is driven to rotate the said element in said first direction reaction force tends to rotate said mounting to increase the pressure contact between said roller and said element, whereas when said friction roller is driven to rotate said element in the reverse direction, the corresponding reaction force tends to reduce such pressure contact.

In an arrangement in accordance with the invention the object is achieved that the force applied by the drive mechanism to move the pivoted member in a downward direction is reduced as the resistance to movement of the pivoted member is increased, for example by contact with an obstruction, whereas the force tending to drive the member in the upward direction is increased in response to an increase in the load thereon, for example if the weight of the member is increased by accumulated ice or snow.

In accordance with one embodiment of the invention the pivoted member comprises a beam or barrier having a generally horizontal rest position when in use, said rotary element is coupled to said pivoted member by way of a connecting rod and the arrangement is such that, during rotation of said element in said reverse direction a crankpin by way of which motion is transmitted to said connecting rod from the said element moves through an overcentre position to a rest position corresponding to the rest position of said beam or barrier. Because of this geometric arrangement, the result is achieved that if force is applied to the beam or barrier in an attempt to raise it from its horizontal rest position, the rotary element coupled thereto tends to be rotated further in the reverse direction, instead of being rotated in the direction in which it would normally drive the barrier in the upward direction. This enables the mechanism to take account of an unauthorised attempt to raise the barrier, for example by the provision of a stop for preventing further rotation of the rotary element in said reverse direction and/or by causing an alarm device to be actuated in response to initial movement of the barrier from its horizontal rest position.

Further preferred features and corresponding advantages of the invention will become apparent from the following description taken in conjunction with the Claims.

Figure 3:
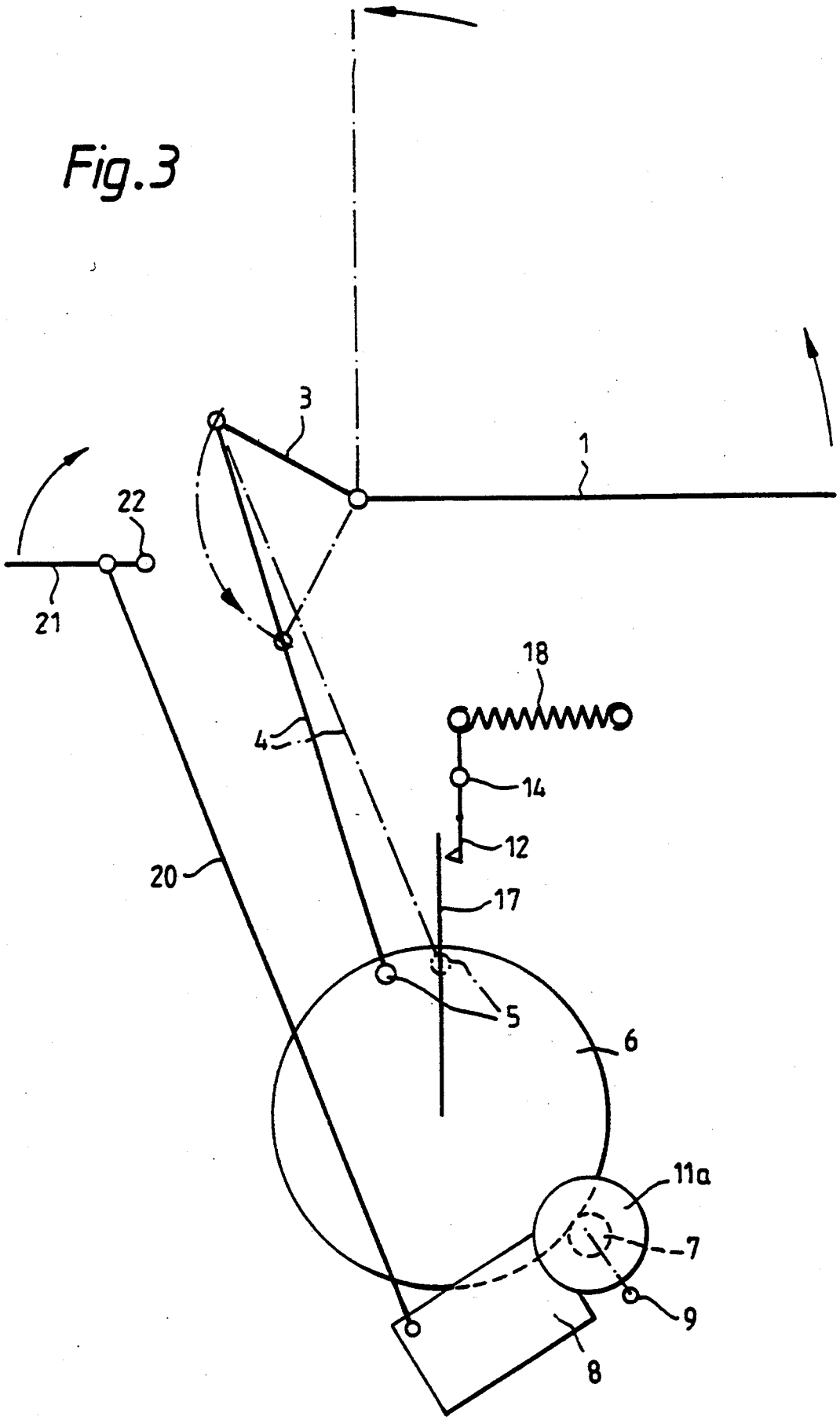
Figure 4:
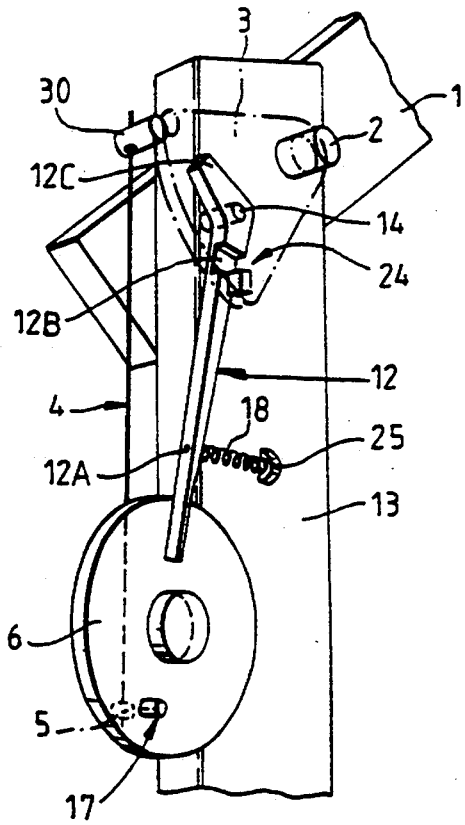

The invention is illustrated by way of example in the accompanying drawings in which:

FIG. 1 is a diagram illustrating the geometric arrangement of a drive mechanism in accordance with the invention, FIG. 2 is a perspective view illustrating one embodiment of the mechanism shown diagrammatically in FIG. 1, FIGS. 2A and 2B are side elevations illustrating relative positions of components of the embodiment of FIG. 2, FIG. 3 is a view similar to FIG. 1, illustrating diagrammatically a further embodiment of the invention, FIG. 4 is a perspective view of one embodiment of the mechanism shown diagrammatically in FIG. 3, and FIGS. 5–7 are side elevations illustrating relative positions of the mechanism of FIG. 4.

Referring to FIG. 1 of the drawings the mechanism comprises a beam 1 rotating about a pivot 2 and connected to a lever 3, the other end of lever 3 being rotatably connected to a crankpin 5 by means of a connecting rod 4. The crankpin 5 is mounted on a crank disk 6. Also shown is a tension spring 10 which may be adjusted to balance the weight of the beam 1. Rotation of the crank disk 6 through approximately 180° will cause the beam 1 to rotate through 90°. The crank disk 6 is driven by a roller 7 which rotates in a bearing forming part of the upper end of a mounting 8. The mounting 8 has a bearing at its lower end which allows it to rotate about a pivot 9. The geometric relationship between the roller 7, the pivot 9 and the crank disk 6 is arranged so that anti-clockwise rotation of the mounting 8 about the pivot 9 forces the roller 7 into closer contact with the crank disk 6 and clockwise rotation of the mounting 8 will eventually disengage the roller 7 from the crank disk 6. Rotation of the roller 7 in a clockwise direction will tend to rotate the mounting 8 anti-clockwise thus increasing friction and therefore drive power between the roller 7 and the crank disk 6. Similarly anti-clockwise rotation of the roller 7 will have the opposite effect.

FIG. 2 shows the friction drive in more detail. The mounting 8 comprises a motor mounting bracket for a reversible electric motor 11 combined with a worm and wheel speed reducer 11A the weight of the motor 11 and gear 11A providing a force to rotate the mounting 8 anti-clockwise. The pivot 9 of the motor mounting bracket, the pivot 2 of the rotating beam 1 and a pivot 6A of the crank disk 6 are all appropriately mounted to a fixed pillar omitted from the drawing for clarity and mounted to the ground in a conventional manner well-known to one skilled in the art. The mechanism is arranged so that anti-clockwise rotation of the crank disk 6 causes the beam 1 to rise and clockwise rotation lowers the beam 1. Since the roller 7 correspondingly rotates anti-clockwise to move the beam 1 down, any resistance to the downward movement of beam 1 will cause the anti-clockwise rotation of roller 7 to reduce contact pressure between roller 7 and crank disk 6 by pivoting the mounting 8 about the pivot 9 in a clockwise direction until, if the beam 1 is prevented from movement, the pressure between the roller 7 and crank disk 6 will reduce to the value that will allow roller 7 to rotate without driving the crank disk 6 and with little or no stress on the motor unit 11. The drive power will automatically return if the obstruction is removed. The opposite is true in that the drive power to raise the beam 1 will increase with increasing resistance, which will offset any temporary increase in weight of beam 1 due for example to an accumulation of ice or snow. Other power sources than an electric motor may be used, and in place of the motor weight being used to provide an anti-clockwise bias to the mounting 8 the motor could be fixed and the roller 7 driven via a belt and pulleys at shafts of the motor 11 and roller 7, the static belt tension then maintaining the anti-clockwise bias.

Although the above-mentioned arrangement provides protection for stresses on the mechanism when the motor 11 is driving the beam 1 in the upward direction, it is desirable that protection also be provided against upward forces placed on the beam 1 whilst the mechanism is static. For this reason, the connecting rod 4 is in the form of an elongate bolt, the stem of which is slidably received within a bore of stub shaft 30 that is linked to the lever 3 in such a manner that it can rotate about its own axis. A compression spring 31 is located around the stem of the connecting rod 4 in order to bias the stub shaft 30 against a bolt head 4A of the connecting rod 4, so that the connecting rod is linked to the lever 3 at its end during normal operation of the mechanism as illustrated for example in FIG. 2A. However, if an upward force exceeding the force of the compression spring 31 is placed upon the beam 1 when the mechanism is in a condition such that the crank disk 6 cannot move to accommodate the movement of the beam 1, the stub shaft 30 will move downwardly along the stem of the connecting rod 4, compressing the spring 31 as illustrated for example in FIG. 2B. Thus damage to the mechanism and/or breakage of the beam 1 can be avoided.

Referring to FIG. 3, there is illustrated a modification of the mechanism of FIG. 1, providing for locking of the mechanism in the position with the beam 1 horizontal, whilst enabling optional manual release of the mechanism from its locked condition to allow for manual raising of the beam 1. In FIG. 3, the connecting rod 4 is illustrated in unbroken lines with the crank pin 5 in the normal top dead centre position in which the beam 1 has reached its lowermost position. However, during movement of the mechanism into a rest condition, as defined by a limit switch and a mechanical stop not illustrated in FIG. 3, the crank pin 5 and the connecting rod 4 can move over centre into the positions shown in broken lines. This over rotation will have little effect on the position of the beam 1, but if the beam 1 is now levered up, the crank disc 6 will tend to rotate further clockwise against a mechanical stop, thus preventing upward movement of the beam 1, assuming that the connecting rod 4 provides a rigid linkage between the crank pin 5 and the lever 3.

It should be noted that, just before the crank pin 5 moves through its over centre position in a clockwise direction, an abutment 17 coupled with the crank disk 6 comes into engagement with a spring loaded abutment illustrated diagrammatically in FIG. 3 as a stop lever 12 pivoted about a pivot 14 and biased by a tension spring 18.

A manually operable lever 21 pivoted about a pivot 22 is coupled to the mounting 8 by means of a connecting rod 20.

The lever 21 may take the form of a key and lock operated lever so that removal of the key will prevent unauthorised manual operation. Raising the lever 21 causes the mounting 8 to rotate clockwise disengaging the roller 7 from the crank disk 6. Tension stored in the spring 18 rotates the crank disk 6 anti-clockwise, removing the locking action. Beam 1 may now be moved to any desired position and retained in that position by lowering the lever 21 to cause the roller 7 to re-engage with the crank disk 6, thus stopping further movement of the beam 1.

Referring to FIGS. 4 to 7, there is illustrated a practical embodiment wherein the arrangement as described with reference to FIG. 3 is applied to an embodiment of drive mechanism as illustrated in FIG. 2. In FIGS. 4 to 7 the same reference numerals illustrate elements already described above, the mounting bracket 8 and the associated drive mechanism to the friction roller 7 being omitted for clarity.

As illustrated in FIG. 4, the beam 1 and the crank disk 6 are each rotatably mounted upon a vertical pillar 13, the pillar 13 likewise serving as a mounting for the pivoted lever 12 that is located on its pivot 14 between a vertical face of the latter and the path of movement of the crank lever 3 coupled to the beam 1. A compression spring 18 that serves to bias the lever 12 in a clockwise direction is anchored between one arm of the lever 12 and a mounting bracket 25 of the pillar 13, the anti-clockwise rotation of the lever 12 being limited by a bolt, not illustrated, anchored to the bracket 25 and passing through an aperture 12A of the lever 12, so that the latter can slide thereon to compress the spring 18. The lever 12 further comprises a notch 12B through which can pass an abutment stop 24 attached to the rear surface of the lever 3 as viewed in FIG. 4, when the lever 12 is pivoted clockwise to its end most position. The free end of lever 12 further comprises a stop abutment 12C for engagement with the abutment stop 24 to lock the beam 1 as described in more detail below. In FIG. 4, the line illustrated by the numeral 4 represents the axis of the connecting rod 4 extending between the crank pin 5 and the stub shaft 30, although it will be appreciated that the construction is as already described with reference to FIG. 2.

Figure 5:
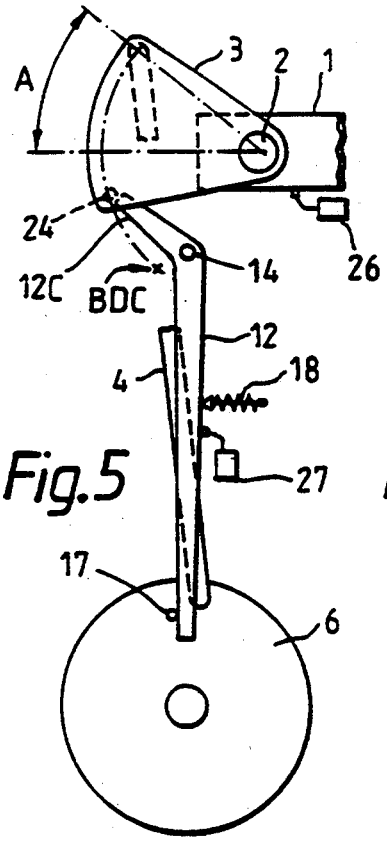

FIG. 5 shows the arrangement of FIG. 4 when the beam 1 is in its horizontal position and the crank pin 5 is in the over centre position as illustrated in broken lines in FIG. 3. In this condition, the lever 12 has been pivoted fully in the anti-clockwise direction by means of an abutment pin, 17 coupled to the cam disk 6 and actuates a micro switch 27 serving as a limit switch for stopping the motor 11. A further micro switch 26 has also been actuated by means of the beam 1 or an extension of the lever 3, not illustrated. In this condition, the spring 18 is held in the compressed state and the abutment end 12C of the lever 12 is located in the path of movement of the abutment stop 24 of the lever 3 in order to prevent unauthorised counter-clockwise rotation of the beam 1. The arrangement is such that there is a small space between the abutment stop 24 and the end of the lever 12C that will allow limited movement of the lever 3 against the force of the compression spring 31 before the stop 24 engages the end 12C of the lever 12. This movement is sufficient to cause release of the micro switch 26 to actuate an alarm circuit (not shown) for warning of unauthorised lifting of the beam 1. The circuitry of the alarm system is interlocked with the micro switch 27 so that the alarm can only be actuated when the micro switch 27 is also actuated by the lever 12. Thus actuation of the alarm is prevented when the beam 1 is raised by the mechanism in the normal way, or when the mechanism is released for manual operation of the arm as described below.

Figure 6:
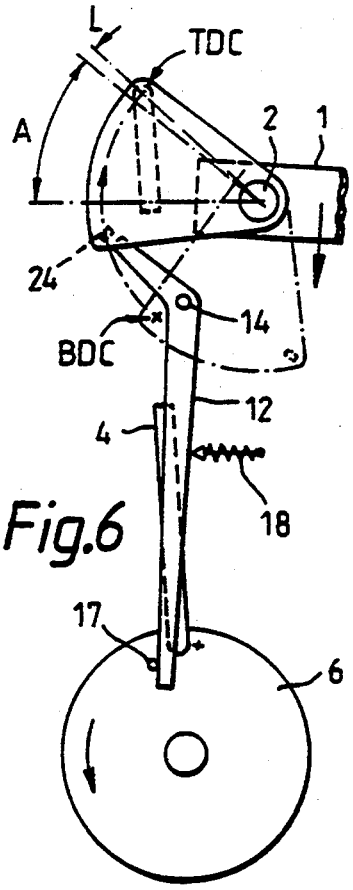
Figure 7:
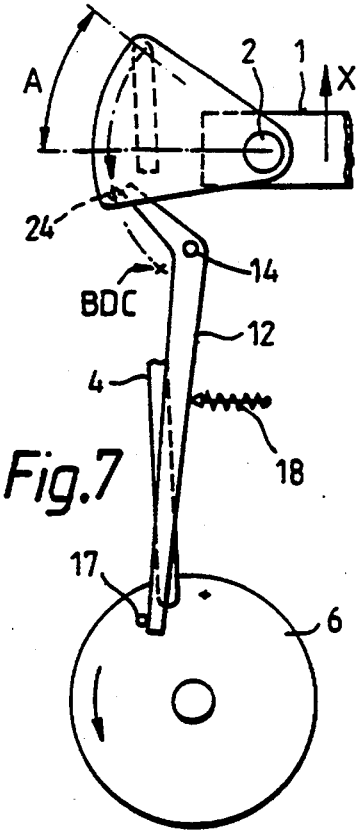

In order to release the mechanism from the locked condition of FIG. 5 to allow manual operation of the beam 1, the lever 21 is actuated manually in the manner described above with reference to FIG. 3, so that the drive to the crank disk 6 is released. The compression spring 18 is thus able to pivot the lever 12 in a clockwise direction, in turn pivoting the crank disk 6 via the abutment pin 17, so that the crank pin 5 and the connecting rod 4 are moved through the over centre position as illustrated in FIG. 6. During this movement the beam 1 dips slightly from its horizontal position, or, alternatively, if the beam is held in a horizontal position by means of a tip rest, the compression spring 31 is compressed sufficiently to allow the crank pin 5 to move through the over centre position. The compression spring 18 then continues to move the lever 12 in the clockwise direction until, as illustrated in FIG. 7, the end 12C of the lever 12 has moved out of the path of the stop abutment 24 and the beam 1 can be lifted manually in the direction of the arrow X in FIG. 7.

The upward movement of the beam 1 from the position of FIG. 5 occurs in precisely the same manner when the crank disk 6 is driven in the anti-clockwise direction under power from the motor 11, and it will be appreciated that the mechanism can be stopped with the arm in its uppermost position in response to actuation of a further limit switch, not shown, arranged for actuation by the lever 3.

It will be appreciated by one skilled in the art that various modifications may be made to the above described arrangement without departing from the scope of the invention. Thus, although the arrangement described incorporates a friction drive provided by wheels 6 and 7, the friction wheels could be replaced by meshing toothed gear wheels. Such an arrangement may be desirable where it is necessary to transmit greater forces than can be accommodated by a friction drive, and will provide a similar advantage in releasing the mesh between the gear wheels if the movement of the beam 1 is obstructed in the downward direction. There would in this case be no corresponding increase in the drive force transmitted in the upward direction, but this would be unnecessary in relation to a geared drive wherein potential slippage between drive wheels is not a problem.

I claim:

1. A drive mechanism including a member (1) pivoted about an axis (2), a rotary element (6) coupled to said member in such a manner that, with said axis horizontal, rotation of said element (6) in a first direction is effective to raise a radially extending portion of said member (1) relatively to said axis (2) and rotation of said element (6) in a reverse direction is effective to lower said portion of said member (1) relatively to said axis (2), and a reversible drive means for driving said element (6) characterised in that said reversible drive means includes a friction roller (7) for engagement with a surface of said element (6) extending circumferentially about the rotary axis thereof, said friction roller (7) being supported for rotation upon a mounting (8) pivoted relatively to the rotary axis of said element and biased in a direction such as to bring the friction roller (7) into pressure contact with said surface, the arrangement being such that when said friction roller (7) is driven to rotate the said element (6) in said first direction reaction force tends to rotate said mounting (8) to increase the pressure contact between said roller (7) and said element (6), whereas when said friction roller (7) is driven to rotate said element (6) in the reverse direction, the corresponding reaction force tends to reduce such pressure contact.

2. A drive mechanism according to claim 1, characterised in that said pivoted member (1) comprises a beam or barrier having a generally horizontal rest position when in use, that said rotary element (6) is coupled to said pivoted member (1) by way of a connecting rod (4) and that the arrangement is such that, during rotation of said element in said reverse direction a crankpin (5) by way of which motion is transmitted to said connecting rod (4) from the said element (6) moves through an overcentre position to a rest position corresponding to the rest position of said beam or barrier.

3. A drive mechanism according to claim 2, characterised in that said rest position of said crankpin (5) is defined by a stop abutment (12) that is resiliently displaceable to accommodate movement of said crankpin beyond its overcentre position.

4. In a drive mechanism including a member pivoted about an axis, a rotary element coupled to said member in such a manner that, with said axis horizontal, rotation of said element in a first direction is effective to raise a radially extending portion of said member relatively to said axis and rotation of said element in a reverse direction is effective to lower said portion of said member relatively to said axis, and a reversible drive means for driving said element, the improvement wherein said reversible drive means includes a friction roller for engagement with a surface of said element extending circumferentially about the rotary axis thereof, said friction roller supported for rotation upon a mounting pivoted relatively to the rotary axis of said element and biased in a direction such as to bring the friction roller into pressure contact with said surface, whereby when said friction roller is driven to rotate the said element in said first direction reaction force tends to rotate said mounting to increase the pressure contact between said roller and said element, whereas when said friction roller is driven to rotate said element in the reverse direction, the corresponding reaction force tends to reduce such pressure contact.

5. A drive mechanism according to claim 4, wherein said pivoted member comprises a barrier having a generally horizontal rest position when in use, said rotary element is coupled to said barrier by way of a connecting rod such that during rotation of said element in said reverse direction a crankpin by way of which motion is transmitted to said connecting rod from the said element moves through an overcenter position to a rest position corresponding to the rest position of said barrier.

6. A drive mechanism according to claim 5, wherein said rest position of said crankpin is defined by a stop abutment that is resiliently displaceable to accommodate movement of said crankpin beyond its overcenter position.

7. A drive mechanism according to claim 6, wherein said connecting rod is coupled to said barrier by means of a resilient lost motion device allowing raising movement of the barrier relatively to its drive mechanism.

8. A drive mechanism according to claim 7, wherein said stop abutment is arranged, upon said resilient displacement thereof, to interlock with said barrier, in order to limit movement of said lost motion device and thus prevent raising of the barrier.

9. A drive mechanism according to claim 5, including an alarm device arranged to be triggered by lifting movement of said barrier when said crankpin is in its rest position.

10. A drive mechanism according to claim 4, wherein said mounting carries a reversible motor arranged to transmit drive to said friction roller, and said motor is so located with reference to the pivot of said mounting that the weight of the motor aids the said bias of the mounting.

11. A drive mechanism according to claim 10, including a remote control device for pivoting said mounting in a direction counter to said bias in order to disengage the friction roller from said element.

12. A drive mechanism according to claim 11, wherein said remote control device comprises a manually operable lever coupled to said mounting by way of a connecting rod.

13. A drive mechanism according to claim 4, wherein end positions of said member are defined by limit switches for controlling the drive of said friction roller said limit switches being arranged for actuation by a member of the drive transmission between and including said member and said rotary element.

* * * * *

UNITED STATES PATENT AND TRADEMARK OFFICE

CERTIFICATE OF CORRECTION

PATENT NO. : 5,415,055

DATED : May 16, 1995

INVENTOR(S) : Kenneth M. HENFREY

It is certified that error appears in the above-indentified patent and that said Letters Patent is hereby corrected as shown below:

Title page, left column, immediately above "[51]...B65B 1/20" insert --[30] Foreign Application Priority Data
Sept. 26, 1990 [GB] United Kingdom...9020919.8--.

Signed and Sealed this

Third Day of October, 1995

*Attest:*

*Attesting Officer*

BRUCE LEHMAN

*Commissioner of Patents and Trademarks*